US007625328B2

(12) United States Patent
Draghetti et al.

(10) Patent No.: US 7,625,328 B2
(45) Date of Patent: Dec. 1, 2009

(54) METHOD OF PRODUCTION OF A CIGARETTE FILTER

(75) Inventors: Fiorenzo Draghetti, Medicina (IT); Ivan Eusepi, Castelmaggiore (IT); Armando Turrini, San Giovanni in Persiceto (IT); Vittorio Sgrignuoli, Bologna (IT); Leonardo Balletti, San Lazzario di Savena (IT)

(73) Assignee: G.D. Societa' per Azioni, Bologna (IT)

( * ) Notice: Subject to any disclaimer, the term of this patent is extended or adjusted under 35 U.S.C. 154(b) by 371 days.

(21) Appl. No.: 11/587,030

(22) PCT Filed: Apr. 20, 2005

(86) PCT No.: PCT/EP2005/051741

§ 371 (c)(1),
(2), (4) Date: Jul. 12, 2007

(87) PCT Pub. No.: WO2005/102080

PCT Pub. Date: Nov. 3, 2005

(65) Prior Publication Data

US 2008/0029115 A1 Feb. 7, 2008

(30) Foreign Application Priority Data

Apr. 22, 2004 (IT) ..... BO2004A0238

(51) Int. Cl.
*B31C 99/00* (2006.01)
*A24D 3/04* (2006.01)

(52) U.S. Cl. ..... 493/47; 493/42; 493/48; 131/344

(58) Field of Classification Search ..... 493/47, 493/39, 42, 46, 48, 49; 131/331, 341, 342, 131/344, 345
See application file for complete search history.

(56) References Cited

U.S. PATENT DOCUMENTS

| | | | | |
|---|---|---|---|---|
| 2,035,211 | A * | 3/1936 | Aivaz | 493/39 |
| 3,066,681 | A | 12/1962 | Cohn | |
| 3,603,058 | A * | 9/1971 | Schubert | 53/525 |
| 3,791,265 | A * | 2/1974 | Westcott et al. | 493/42 |
| 3,882,877 | A | 5/1975 | Brackmann et al. | |
| 3,958,498 | A * | 5/1976 | Payne | 493/4 |
| 4,034,765 | A * | 7/1977 | Hall | 131/336 |
| 5,019,262 | A | 5/1991 | Wang et al. | |
| 7,004,896 | B2 * | 2/2006 | Heitmann et al. | 493/39 |
| 7,240,678 | B2 * | 7/2007 | Crooks et al. | 131/212.2 |

(Continued)

FOREIGN PATENT DOCUMENTS

EP 0 568 278 11/1993

(Continued)

OTHER PUBLICATIONS

International Search Report in PCT/EP2005/051741 dated Jun. 16, 2005.

*Primary Examiner*—Paul R Durand
(74) *Attorney, Agent, or Firm*—Marshall, Gerstein & Borun LLP

(57) ABSTRACT

A filter for a cigarette has an organic filtering portion defined by granules or fibres of active carbon and housed inside a cylindrical shell of plastic material; the shell is located between a portion of cellulose acetate, which is engaged orally by a user, and a cigarette portion, and has a bottom, contacting the portion of cellulose acetate and hermetically supporting a particulate trap for retaining fine particulate, and an end contacting the cigarette portion and closed by a plug of cellulose acetate.

10 Claims, 7 Drawing Sheets

| | | | | |
|---|---|---|---|---|
| 7,479,099 | B2 * | 1/2009 | Scott et al. | 493/47 |
| 2002/0119873 | A1 * | 8/2002 | Heitmann | 493/39 |
| 2004/0045566 | A1 | 3/2004 | Pera | |

FOREIGN PATENT DOCUMENTS

| | | |
|---|---|---|
| EP | 0 623 291 | 11/1994 |
| FR | 1431434 | 3/1966 |
| GB | 1058343 | 2/1967 |
| GB | 1 257 684 | 12/1971 |
| GB | 1329956 | 9/1973 |
| WO | WO-03/086117 | 10/2003 |

* cited by examiner

METHOD OF PRODUCTION OF A CIGARETTE FILTER

CROSS-REFERENCE TO RELATED APPLICATION

This application claims the benefit of International Application No. PCT/EP2005/051741, filed Apr. 20, 2005, which claims the benefit of Italian patent application number BO2005A 000238, filed Apr. 22, 2004.

TECHNICAL FIELD

The present invention relates to a method of production of a cigarette filter.

BACKGROUND ART

Until a few years ago, shop-bought filter-tipped cigarettes comprised a filter made solely of one portion of cellulose acetate formed from a strip of cellulose acetate, which is stretched, impregnated with plasticizing additives, and rolled to form a cylindrical rod which is then wrapped in a sheet of paper material.

A filter made of a single portion of cellulose acetate is capable of blocking and retaining course particulate and moisture present in tobacco smoke, but fails to adequately block volatile substances in the smoke. For which reason, a cigarette filter has recently been proposed, in which a further filtering portion, comprising active-carbon granules, is interposed between two portions of cellulose acetate. Various tests, in fact, have shown the filtering portion of active-carbon granules to be highly effective in blocking and retaining volatile substances present in tobacco smoke; and the active-carbon granules may be combined with additives to selectively block targeted substances in the smoke.

U.S. Pat. No. 3,066,681A1 discloses a cigarette comprising a cylindrical body of tobacco, a wrapping sheet around the tobacco, and a cylindrical cartridge proximate one end of the tobacco body and in alignment therewith including a liquid-impregnated porous mass of filter material, a shell having a liquid proof cartridge wrapper around the mass of filter material, and means extending across at least one end of the cartridge wrapper including a liquid proof and smoke-permeable membrane.

GB1329956A discloses a tobacco-smoke filter comprising at least three different filtering agents, at least one of which agents is primarily intended to remove smoke components with a particle diameter of more than 0.1 micron, and at least one other of which agents is a polar adsorption agent intended to remove chemically polar smoke components with a particle diameter of less than 0.1 micron. The specified polar adsorption agent is porous magnesium silicate of 0.1-2.0 mm particle size, and the agent for removing particles of more than 0.1 micron diameter may be a wad of cellulose acetate or crepe paper.

DISCLOSURE OF INVENTION

It is an object of the present invention to provide a method of production of a cigarette filter which is cheap and easy.

According to the present invention, there is provided a method of producing a cigarette filter, as recited in the accompanying Claims.

BRIEF DESCRIPTION OF THE DRAWINGS

A number of non-limiting embodiments of the present invention will be described by way of example with reference to the accompanying drawings, in which.

BEST MODE FOR CARRYING OUT THE INVENTION

Figure 1:
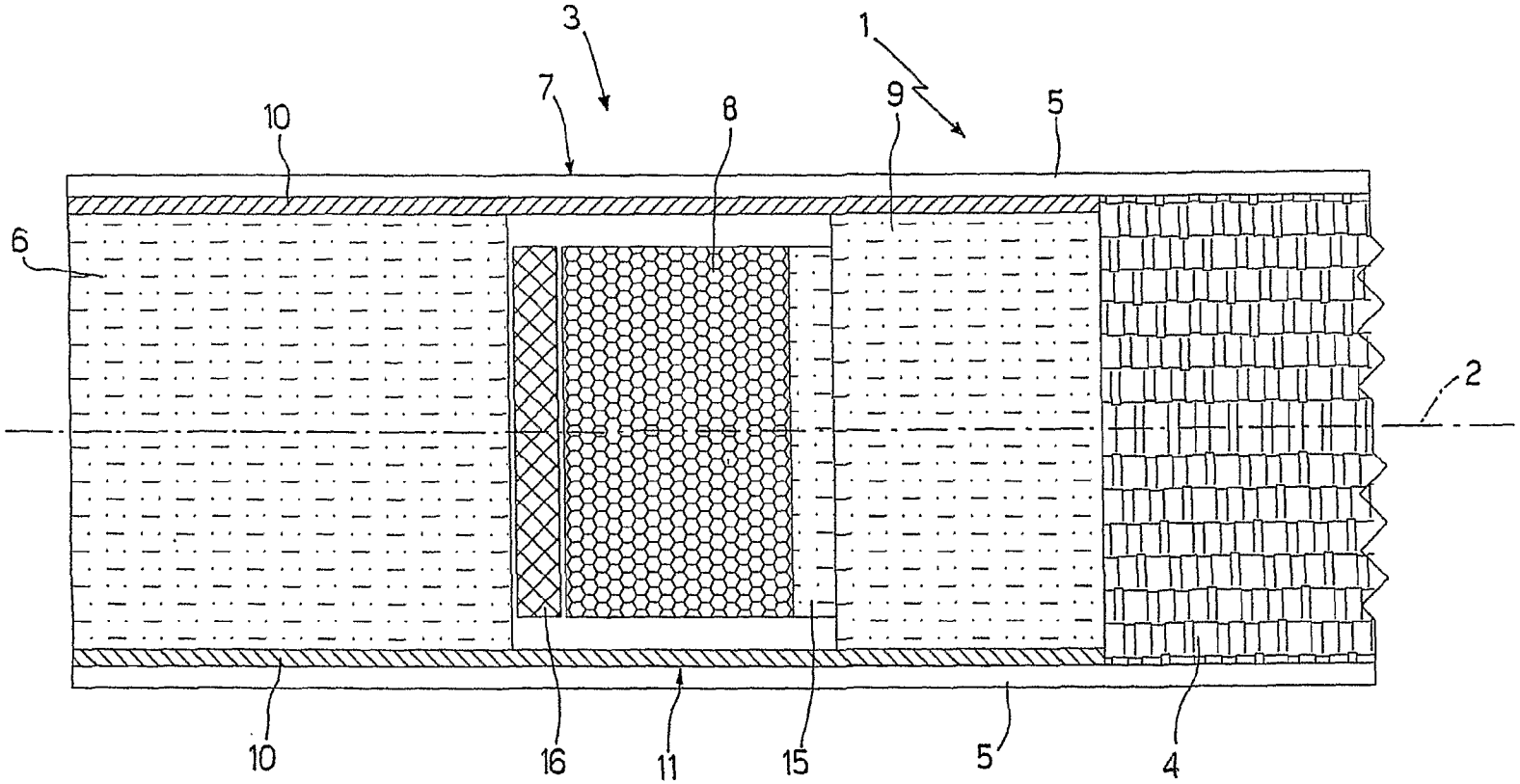
FIG. 1 shows a side view in section of a cigarette filter in accordance with the present invention.
Figure 2:
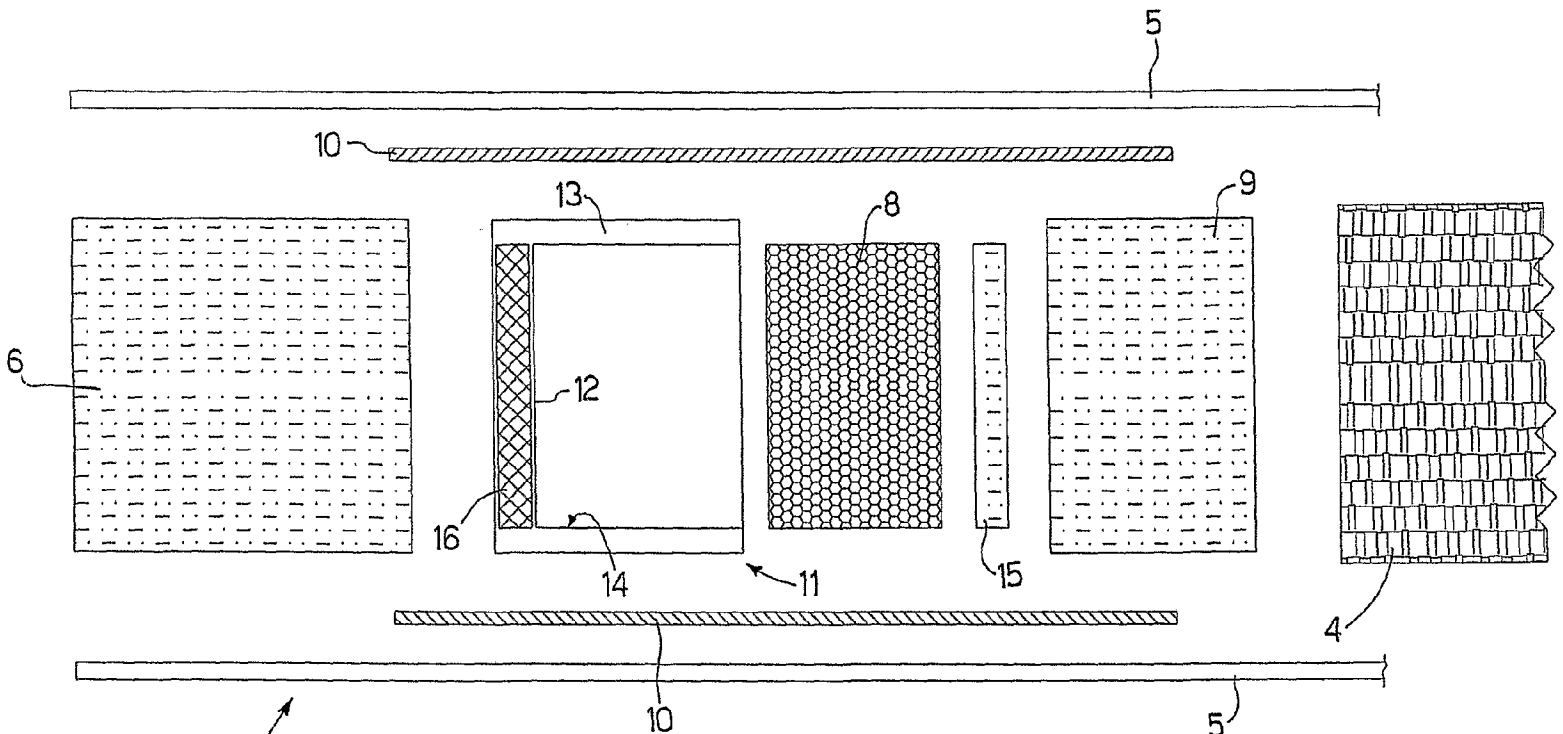
FIG. 2 shows an exploded side view of the FIG. 1 filter.

Number 1 in FIGS. 1 and 2 indicates as a whole a cigarette, which is cylindrical with a central axis 2 of symmetry, and comprises a filter 3 and a tobacco portion 4 joined to each other by a band 5 of paper material.

Filter 3 comprises a passive filtering portion 6 located at the opposite end of filter 3 to tobacco portion 4, and which is engaged orally by the user; an organic filtering portion 7 comprising granules or fibres 8 of active carbon or other organic substance; and a further passive filtering portion 9 located at the end of filter 3 contacting tobacco portion 4. Passive filtering portions 6, 9 and organic filtering portion 7 are joined to one another by a band 10 of paper material.

Passive filtering portions 6 and 9 are preferably made of cellulose acetate, and in particular from a strip of cellulose acetate, which is stretched, impregnated with plasticizing additives, and rolled to form a cylindrical rod which is then wrapped in a sheet of paper material.

Organic filtering portion 7 is housed inside a cartridge or shell 11 having a bottom wall 12 from which a cylindrical lateral wall 13 extends upwards. Bottom wall 12 and cylindrical lateral wall 13 define a seat 14 housing active-carbon granules 8, and which is bounded and closed at the top by a filtering plug 15 made of cellulose acetate and pressed inside seat 14 at the opposite end to bottom wall 12. Shell 11 is preferably made of plastic or any other material impermeable to air and/or smoke.

In a different embodiment not shown, passive filtering portion 9 may be dispensed with, or passive filtering portion 6 may be integral with shell 11.

A particulate trap 16 for retaining fine particulate is embedded in bottom wall 12 of shell 11, and is defined by a porous membrane (or porous-membrane filter). In a different embodiment, particulate trap 16 is defined by a mesh (or mesh filter) with an average mesh size of roughly 1 micron. In the embodiment shown, particulate trap 16 blocks and retains particulate of an average diameter of over 1 micron. In alternative embodiments not shown, particulate trap 16 blocks and retains particulate of an average diameter of over 0.2 or 5 microns. The filtering capacity of particulate trap 16 is normally selected according to the characteristics of the tobacco in tobacco portion 4 and of the organic substance in organic filtering portion 7.

It is important to note that shell 11 is oriented with bottom wall 12, and therefore particulate trap 16, between passive filtering portion 6 and organic filtering portion 7.

Figure 3:
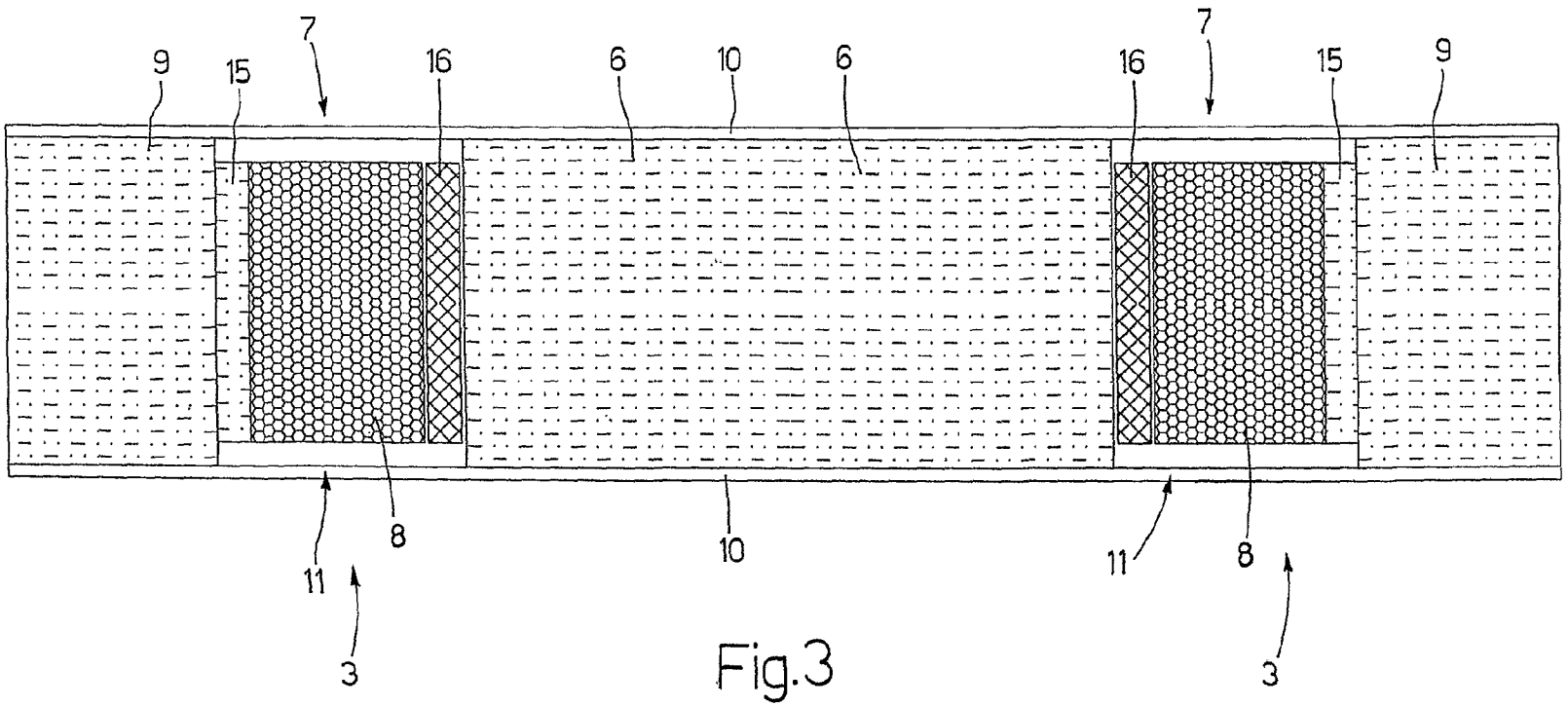
FIG. 3 shows a side view in section of a further embodiment of a cigarette filter in accordance with the present invention.

FIG. 3 shows a double filter defined by the union of two filters 3 of the type described above. More specifically, the two filters 3 are joined at respective passive filtering portions 6, which preferably form one body which is cut in half to separate the two filters 3.

When cigarette 1 is lit by the user, the smoke produced by combustion of the end portion of tobacco portion 4 flows through tobacco portion 4 to filter 3. The smoke first flows through passive filtering portion 9, which blocks and retains course particulate and moisture in the smoke, and then through organic filtering portion 7, which blocks and retains the volatile substances in the smoke.

When hot smoke flows through granules of an organic substance, particularly active-carbon granules 8, the organic substance has been found to release into the smoke fine particulate of less than 10-micron average diameter (known as "PM10"), and which is blocked and retained by particulate trap 16 located downstream from active-carbon granules 8. In other words, the smoke produced by tobacco combustion contains course particulate (which is blocked by passive filtering portion 9) but substantially no fine particulate; and the smoke, as it flows through organic filtering portion 7, is charged with fine particulate released by organic filtering portion 7 itself, and which is blocked and retained by particulate trap 16.

Fine particulate is especially harmful to health, in that, whereas course particulate is expelled from the lungs, fine particulate adheres inside the alveoli and is never expelled, not even after a prolonged period of time.

FIGS. 4 to 11 show, schematically, a sequence of operations by which to produce a cigarette filter 3 of the type shown in FIG. 1. More specifically, the operations in FIGS. 4 to 11 relate to filling shell 11 with active-carbon granules 8, and subsequently fitting plug 15 to shell 11.

Figure 4:
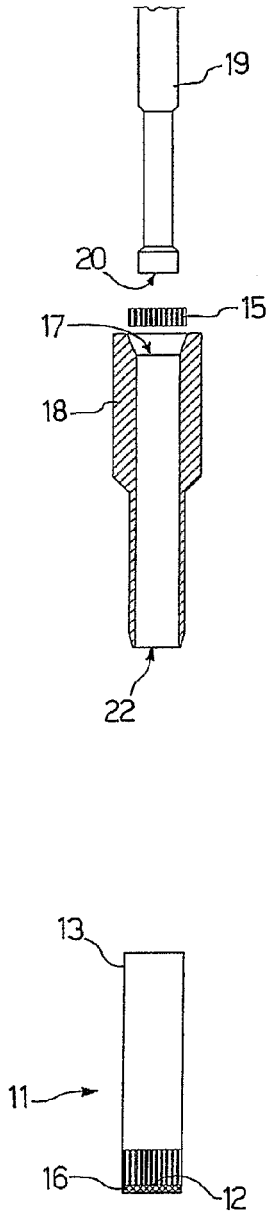
FIGS. 4 to 11 show schematic lateral sections of a sequence of operations by which to form part of the FIG. 1 filter.

FIG. 4 shows an empty shell 11 having cylindrical bottom wall 12, from which lateral wall 13 extends vertically upwards. More specifically, initially, the axial length of lateral wall 13 is greater than the axial length of lateral wall 13 of the finished filter 3.

Figure 5:
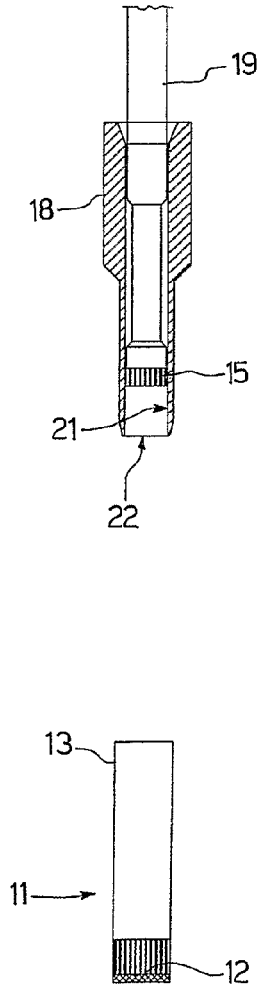

As shown in FIG. 4, a plug 15 is fed into position over an inlet 17 of a vertical tubular spindle 18. Next, as shown in FIG. 5, a plunger 19 is inserted inside spindle 18 through inlet 17 to force plug 15, resting against a thrust surface 20 of plunger 19, inside spindle 18 (more specifically, plug 15 contracts elastically to enter spindle 18). Inside spindle 18, a cylindrical chamber 21 is thus defined, is bounded at the top by plug 15 and laterally by the wall of spindle 18, and has an open bottom end coincident with an outlet 22 of spindle 18.

Figure 6:
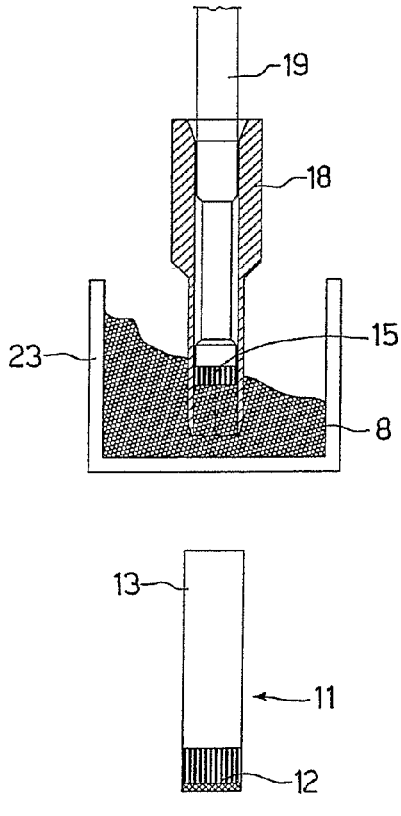

Next, as shown in FIG. 6, spindle 18 and plunger 19 are inserted inside a container 23 of active-carbon granules 8 to fill cylindrical chamber 21 with active-carbon granules 8, which are retained inside cylindrical chamber 21 by generating suction through thrust surface 20 of plunger 19; for which purpose, thrust surface 20 of plunger 19 comprises a number of holes (not shown) smaller than active-carbon granules 8 and connected pneumatically to a suction pump (not shown) by a connecting conduit (not shown) extending inside plunger 19. In an alternative embodiment, suction inside cylindrical chamber 21 is also generated through the lateral wall of spindle 18.

Figure 7:
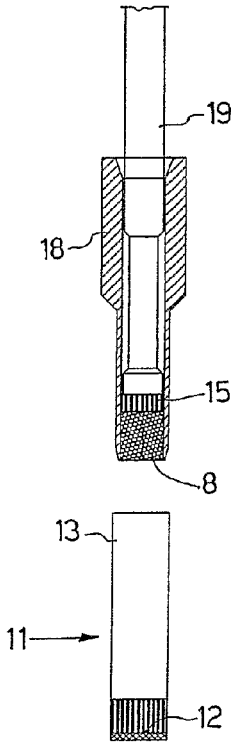
Figure 8:
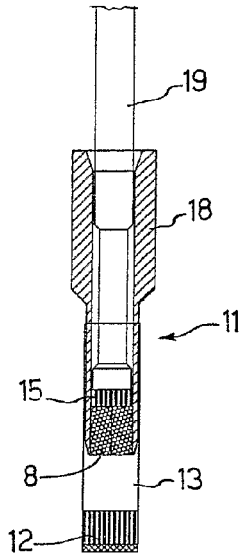
Figure 9:
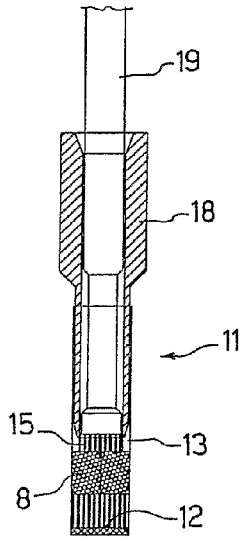

As shown in FIGS. 7 and 8, spindle 18, carrying active-carbon granules 8, is inserted partly inside shell 11. At which point, as shown in FIG. 9, active-carbon granules 8 are fed from cylindrical chamber 21 into shell 11 by moving plunger 19 axially with respect to spindle 18 and simultaneously cutting off suction through thrust surface 20 of plunger 19. As shown clearly in FIG. 8, the thrust movement of plunger 19 injects into shell 11 both active-carbon granules 8 and plug 15, which, as it comes out through the outlet of spindle 18, expands elastically to press tightly against the inner wall of shell 11.

Figure 10:
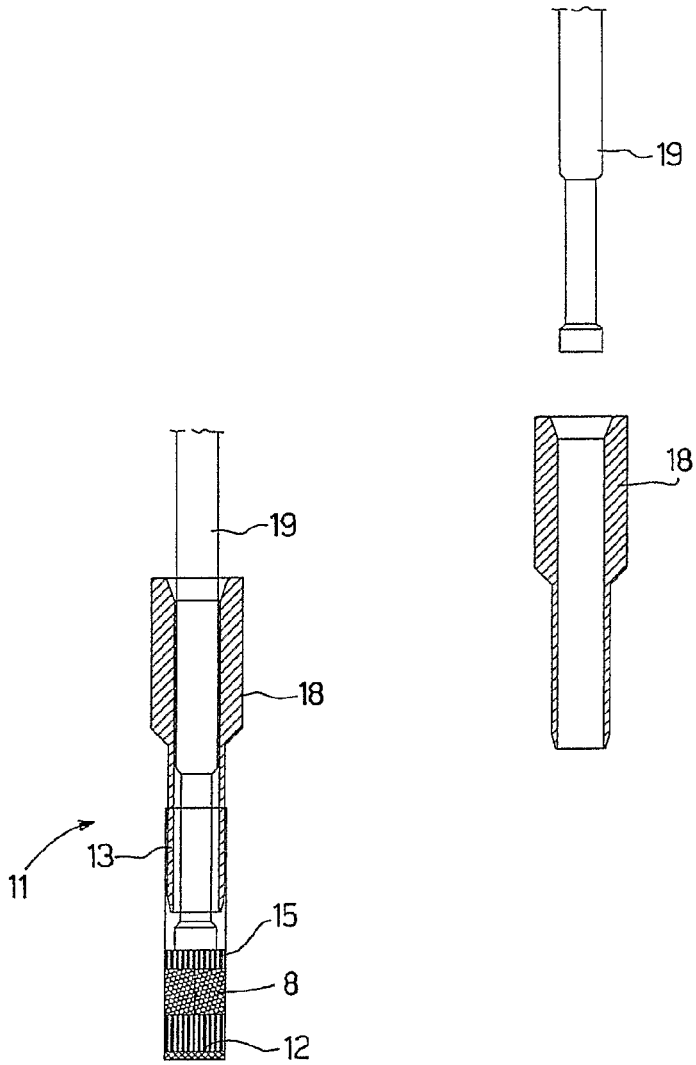
Figure 11:
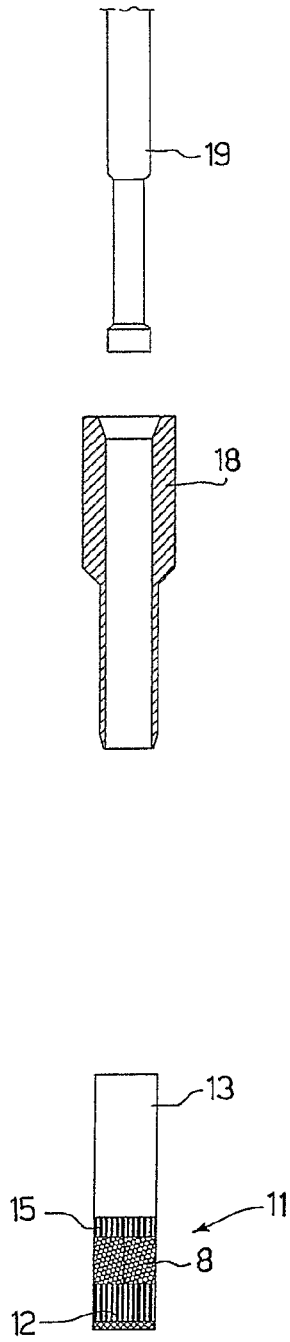

Once active-carbon granules 8 are fed from cylindrical chamber 21 into shell 11, spindle 18 and plunger 19 are withdrawn from shell 11. As shown in FIGS. 10 and 11, spindle 18 is withdrawn first from shell 11, leaving plunger 19 in contact with plug 15; and plunger 19 is then also withdrawn from shell 11.

Finally, lateral wall 13 of shell 11 is cut to shorten it to the axial length of the finished filter 3.

Figure 12:
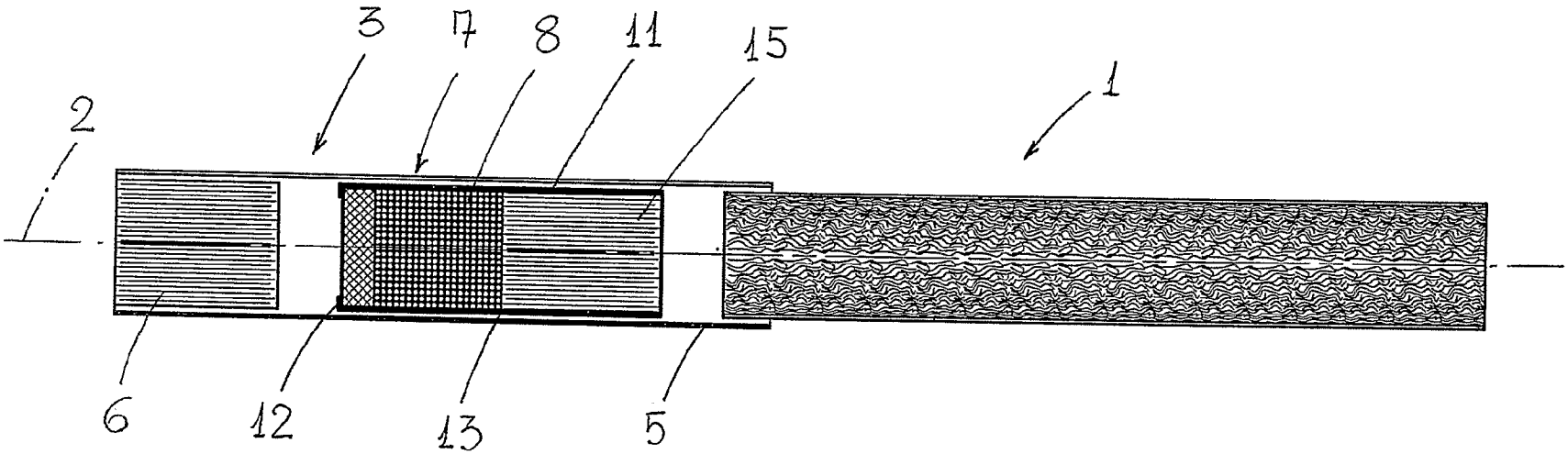
FIG. 12 shows a simplified variation of the FIGS. 1 and 2 cigarette.

FIG. 12 shows a cigarette 1, which differs from the cigarette in FIGS. 1 and 2 by having no filtering-portion 9 and no band 10, and by bottom wall 12 of shell 11 being an annular wall hermetically supporting particulate trap 16. More specifically, trap 16 is glued to the face of wall 12 facing inwards of shell 11.

It should be pointed out that, in both the FIG. 12 and FIGS. 1 and 2 cigarettes, shell 11, complete with trap 16 and plug 15, and filled with active-carbon granules or fibres 8, constitutes a finished part, which can be handled on a filter assembly machine in exactly the same way as filtering portion 6 to assemble filter 3 on the same filter assembly machine.

Moreover, besides plastic or any other material impermeable to air and/or smoke, shell 11 may also be made from the same material and/or with the same structure as trap 16, regardless of whether trap 16 is embedded in wall 12 or glued to the face of wall 12 facing inwards of shell 11.

The invention claimed is:

1. A method of producing a filter (3) for a cigarette (1), the filter comprising an organic filtering portion (7), in turn comprising granules (8) of an organic substance and house inside a cylindrical shell (11); and the method is characterized by comprising the steps of:

inserting a plunger (19) inside a tubular spindle (18) to define a cylindrical chamber (21) inside the spindle (18);

inserting the spindle (18) and the plunger (19) inside a container (23) of granules (8) of the organic substance, so as to fill the cylindrical chamber (21) with granules (8) of the organic substance;

retaining the granules (8) of the organic substance inside the cylindrical chamber (21) by means of suction;

inserting the spindle (18) partly inside the shell (11);

feeding the granules (8) of the organic substance from the cylindrical chamber (21) of the spindle (18) into the shell (11) by moving the plunger (19) axially with respect to the spindle (18); and withdrawing the spindle (18) and the plunger (19) from the shell (11).

2. A method as claimed in claim 1, and comprising the further step of feeding an elastic plug (15) into position over an inlet (17) of the spindle (18) before inserting the plunger (19) inside the spindle (18) through said inlet (17); as the plunger (19) is inserted inside the spindle (18) through the inlet (17), the plug (15) being pushed by the plunger (19) along the spindle (18) to form a bottom wall (12) of the cylindrical chamber (21); the granules (8) of the organic substance being fed into the cylindrical chamber (21) through an outlet (22) of the spindle (18) opposite the inlet (17); and the plug (15) being fed from the spindle (18) into the shell (11) together with the granules (8) of the organic substance by moving the plunger (19) axially with respect to the spindle (18).

3. A method as claimed in claim 1, wherein suction inside the cylindrical chamber (21) is generated through a thrust surface (20) of the plunger (19).

4. A method as claimed in claim 1, wherein suction inside the cylindrical chamber (21) is generated through the lateral wall of the spindle (18).

5. A method as claimed in claim 1, wherein the shell (11) comprises a lateral wall (13) of an axial length greater than the axial length of the same lateral wall (13) of the finished filter (3); an end portion of the lateral wall (13) being cut after the spindle (18) is withdrawn from the shell (11).

6. A method as claimed in claim 1, wherein, initially, only the spindle (18) is withdrawn from the shell (11), the plunger (19) remaining stationary.

7. A method as claimed in claim 1, wherein a particulate trap (16) for retaining fine particulate is located in a bottom surface of the shell (11).

8. A method as claimed in claim 7, wherein the particulate trap (16) is defined by a porous membrane (16).

9. A method as claimed in claim 7, wherein the particulate trap (16) is defined by a mesh.

10. A method as claimed in claim 1, wherein the organic filtering portion (7) comprises granules or fibres (8) of active carbon.

* * * * *